US007985099B2

(12) United States Patent
Wu

(10) Patent No.: US 7,985,099 B2
(45) Date of Patent: Jul. 26, 2011

(54) ELECTRICAL CONNECTOR WITH IMPROVED HOUSING BACKGROUND OF THE INVENTION

(75) Inventor: Chun-Kwan Wu, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/804,985

(22) Filed: Aug. 2, 2010

(65) Prior Publication Data

US 2011/0028040 A1 Feb. 3, 2011

(30) Foreign Application Priority Data

Jul. 31, 2009 (TW) ..... 98125950 A

(51) Int. Cl.
*H01R 24/00* (2006.01)

(52) U.S. Cl. ..... 439/626; 439/74

(58) Field of Classification Search ..... 439/626, 439/74

See application file for complete search history.

(56) References Cited

U.S. PATENT DOCUMENTS

| | | | | |
|---|---|---|---|---|
| 6,976,853 | B2 * | 12/2005 | Goto | 439/74 |
| 7,278,861 | B2 * | 10/2007 | Kishi et al. | 439/74 |
| 7,410,364 | B2 * | 8/2008 | Kishi et al. | 439/74 |
| 7,467,954 | B2 * | 12/2008 | Shiu | 439/74 |
| 7,588,443 | B2 * | 9/2009 | Wu et al. | 439/74 |
| 7,717,719 | B2 * | 5/2010 | Miyazaki et al. | 439/74 |
| 7,736,177 | B2 * | 6/2010 | Tsai | 439/570 |
| 7,744,377 | B2 * | 6/2010 | Wu et al. | 439/74 |
| 2004/0157478 | A1 * | 8/2004 | Midorikawa et al. | 439/74 |
| 2005/0070137 | A1 * | 3/2005 | Goto | 439/74 |
| 2005/0101163 | A1 * | 5/2005 | Obikane et al. | 439/74 |
| 2006/0040525 | A1 * | 2/2006 | Takano et al. | 439/74 |
| 2006/0178022 | A1 * | 8/2006 | Liu | 439/74 |
| 2007/0020966 | A1 * | 1/2007 | Lee et al. | 439/74 |
| 2007/0020967 | A1 * | 1/2007 | Midorikawa | 439/74 |
| 2007/0141866 | A1 * | 6/2007 | Kishi et al. | 439/74 |
| 2007/0141867 | A1 * | 6/2007 | Kishi et al. | 439/74 |
| 2007/0232092 | A1 * | 10/2007 | Michida | 439/74 |
| 2007/0275575 | A1 * | 11/2007 | Wang | 439/74 |
| 2008/0038939 | A1 * | 2/2008 | Wu et al. | 439/55 |
| 2009/0176386 | A1 * | 7/2009 | Wu | 439/74 |
| 2009/0286428 | A1 * | 11/2009 | Wu et al. | 439/752.5 |
| 2010/0068900 | A1 * | 3/2010 | Wu et al. | 439/74 |
| 2010/0081330 | A1 * | 4/2010 | Wu et al. | 439/626 |
| 2011/0028040 | A1 * | 2/2011 | Wu | 439/626 |

FOREIGN PATENT DOCUMENTS

| | | |
|---|---|---|
| TW | M302787 | 12/2006 |

* cited by examiner

*Primary Examiner* — T C Patel
*Assistant Examiner* — Vladimir Imas
(74) *Attorney, Agent, or Firm* — Wei Te Chung; Andrew C. Cheng; Ming Chieh Chang

(57) ABSTRACT

An electrical connector is provided and includes a housing having a pair of side walls defining a plurality of terminal grooves therein and a bottom wall connecting with said side walls and defining a top face facing upward. A plurality of terminals are received in said terminal grooves, each comprising a retaining portion and a contacting portion extending from the retaining portion, said contacting portion having a connecting portion cantilevered above said top face. The bottom wall defines a plurality of through holes running therethrough along a vertical direction and facing to an end of the connecting portion which is far away from the retaining portion, and said top face of the bottom wall extends slantwise from the through hole to the side walls therefore places adjacent to the through hole are lower than those adjacent to the side walls in said vertical direction.

15 Claims, 5 Drawing Sheets

ELECTRICAL CONNECTOR WITH IMPROVED HOUSING BACKGROUND OF THE INVENTION

BACKGROUND OF THE INVENTION

1. Field of the Invention

The present invention relates to an electrical connector, and more particularly to an electrical connector having a housing for securing a plurality of terminals therein.

2. Description of the Related Art

TW Patent No. M302787 issued to ENTERY INDUSTRIAL CO., LTD. on Dec. 11, 2006 discloses a board to board connector assembly including a receptacle connector and a plug connector. The receptacle connector includes an insulative housing defining a receiving room therein for receiving said plug connector and a tongue plate with a plurality of terminal grooves therein disposed in, said receiving room. A plurality of terminals are secured in said terminal grooves, each of which comprises a retaining portion fixed in the insulative housing, an U shaped contacting portion extending from the retaining portion and disposed in said receiving room, and a solder portion projecting out of the insulative housing.

As the terminal grooves are running through the insulative housing along a vertical direction for allowing the terminals to be inserted thereinto directly from a bottom face of the insulative housing, which is benefit for reducing the height of the receptacle connector, while, if the height of the insulative housing is reduced, the rigidity of the insulative housing is simultaneously weakened and not advantageous for manufacturing. There is also another problem, the U shaped contacting portion needs a deflectable space when mating with the plug connector, which ask for the insulative housing to increase its height, obviously, that is not the industry wanted. Under this condition, an improved board to board connector assembly is highly desired to overcome the aforementioned problem.

SUMMARY OF THE INVENTION

Accordingly, an object of the present invention is to provide an electrical connector adapted for the miniaturization trend and still keeping rigidity of the insulative housing.

In order to achieve the object set forth, An electrical connector is provided and includes a housing having a pair of side walls defining a plurality of terminal grooves therein and a bottom wall connecting with said side walls and defining a top face facing upward. A plurality of terminals are received in said terminal grooves, each comprising a retaining portion and a contacting portion extending from the retaining portion, said contacting portion having a connecting portion cantilevered above said top face. The bottom wall defines a plurality of through holes running therethrough along a vertical direction and facing to an end of the connecting portion which is far away from the retaining portion, and said top face of the bottom wall extends slantwise from the through hole to the side walls therefore places adjacent to the through hole are lower than those adjacent to the side walls in said vertical direction.

Other objects, advantages and novel features of the invention will become more apparent from the following detailed description of the present embodiment when taken in conjunction with the accompanying drawings.

DETAILED DESCRIPTION OF THE INVENTION

Figure 1:
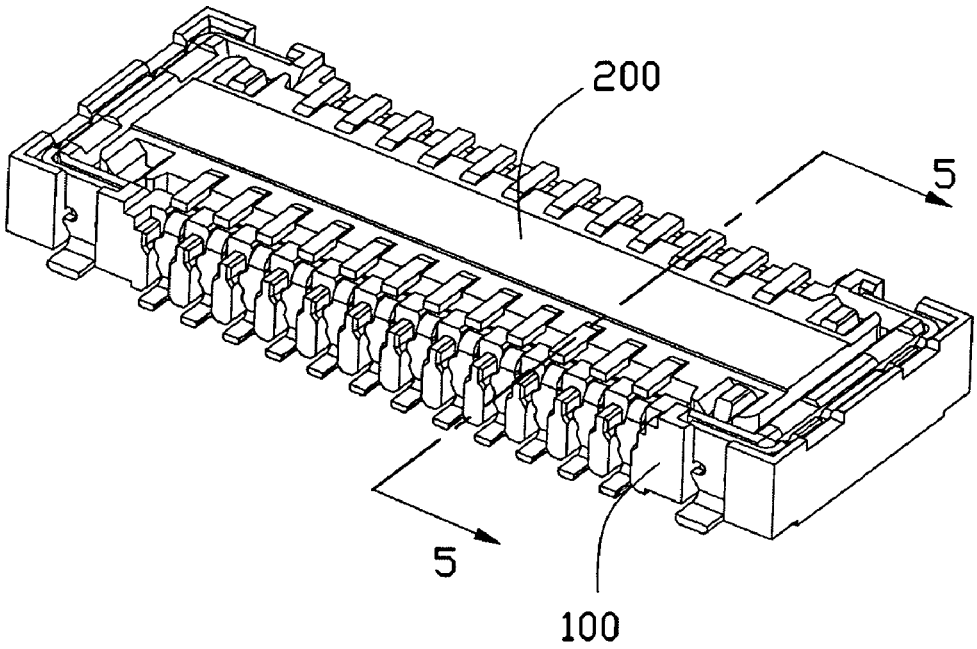
FIG. 1 is an assembled perspective view of an electrical connector in accordance with the present invention mating with a plug connector.
Figure 2:
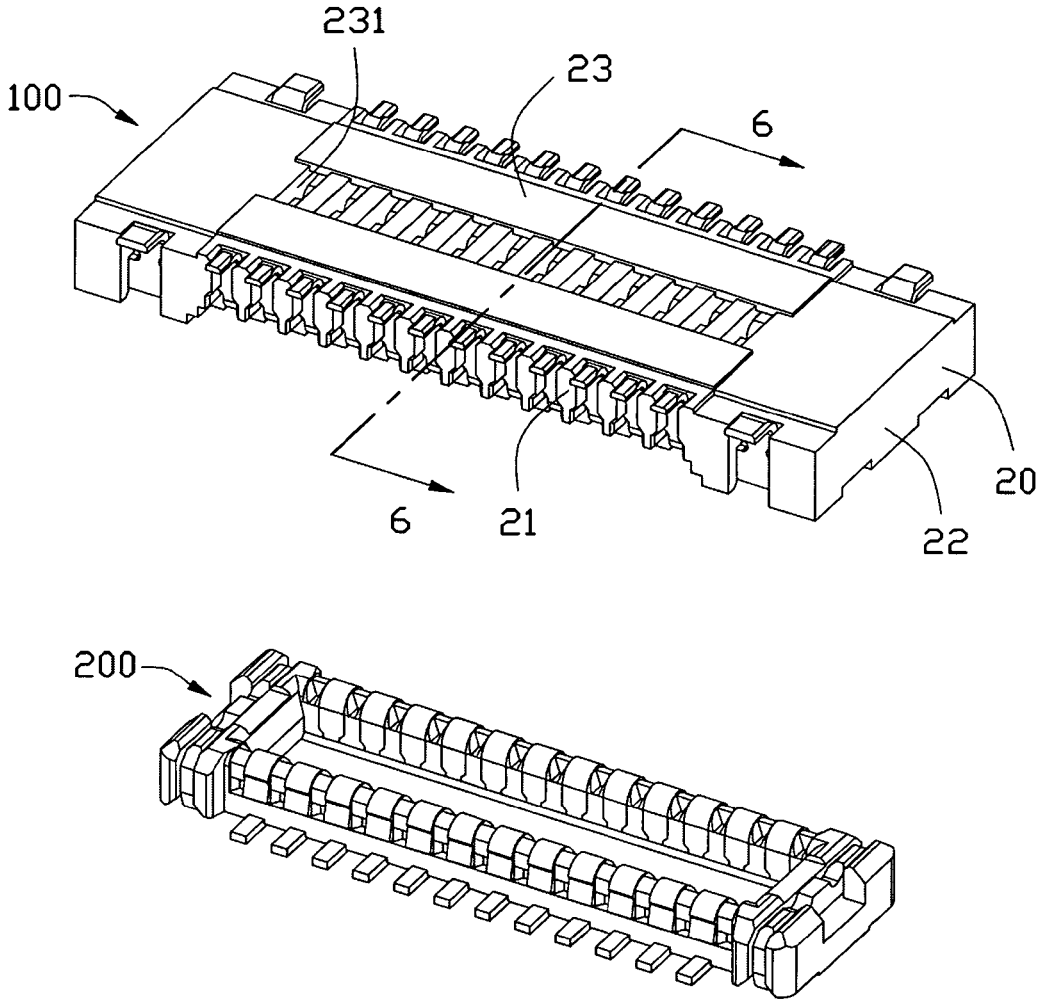
FIG. 2 is a perspective view of the electrical connector and the plug connector shown in FIG. 1, which shows the unmating status.

Reference will now be made to the drawing figures to describe a preferred embodiment of the present invention in detail. Referring to FIGS. 1 and 2, an electrical connector 100 made according to the preferred embodiment of the present invention is provided and mounted onto a printed circuit board (not shown) for mating with a plug connector 200.

Figure 3:
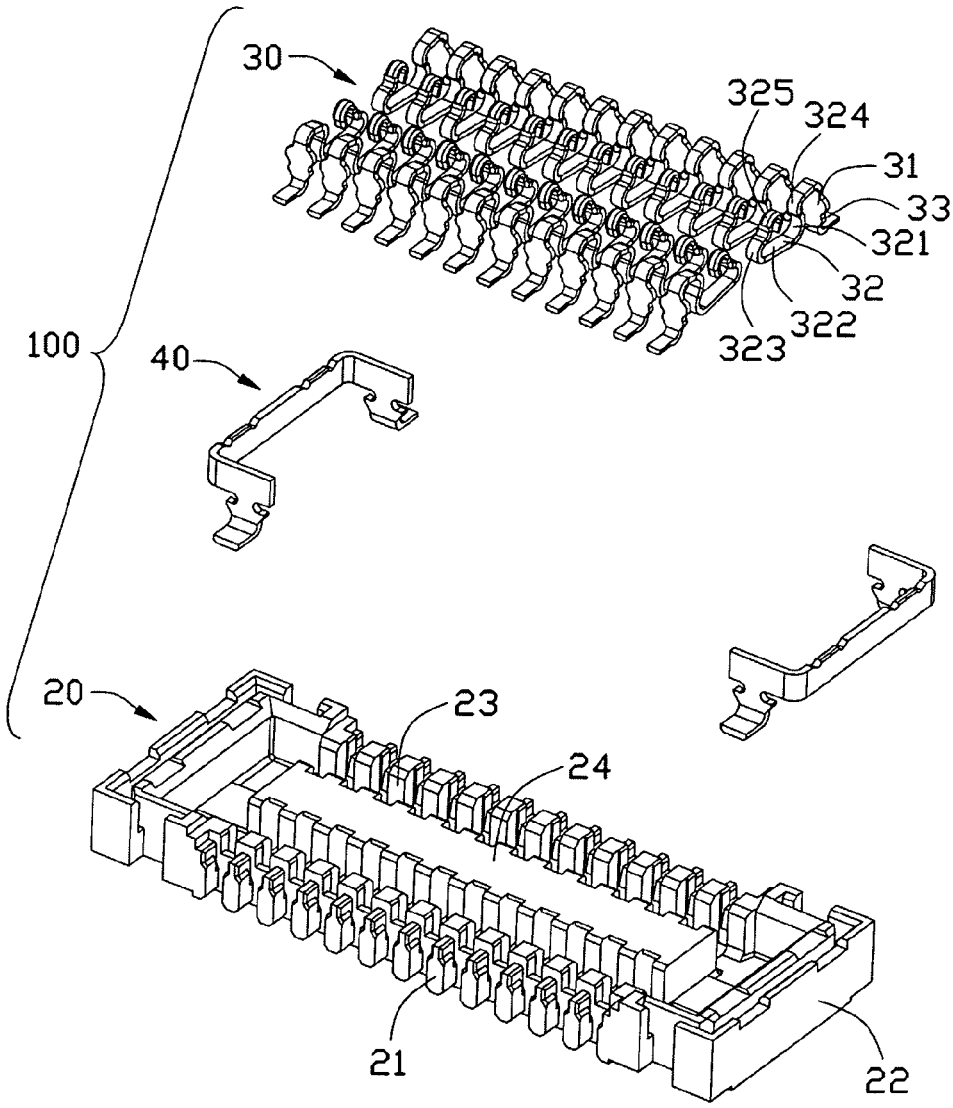
FIG. 3 is an exploded perspective view of the electrical connector shown in FIG. 1.

Referring to FIGS. 2 and 3, the electrical connector 100 comprises an elongated housing 20, a plurality of conductive contacts 30 retained in the housing 20 and a pair of retaining plates 40 assembled on opposite ends of the housing 20. The housing 20 has a pair of opposite side walls 21 extending along a longitudinal direction, a pair of end walls 22 connecting with the side walls 21 and a bottom wall 23 located under said side walls 21 and end walls 22 thereby defining a mating cavity 25 therebetween for receiving said plug connector 200. A plurality of terminal grooves 26 are defined in said mating cavity 25 for receiving said conductive contacts 30. A tongue plate 24 extends upward from said bottom wall 23 of the housing 20 and projects into the mating cavity 25. A plurality of passageways 241 recess inwardly from opposite side surfaces of the tongue plate 24 and are staggered with each other along the longitudinal direction. In addition, a plurality of through holes 231 are defined under the tongue plate 24 and run through the bottom wall 23 along a vertical direction to be in communication with the corresponding passageways 241, which provides an exit for the die during the molding process.

The bottom wall 23 is helpful for improving the rigidity of the housing 20 and comprises a horizontal top face 232 facing the mating cavity 25 and a bottom face 233 opposite to the top face 232. Each of the side walls 21 has an inner face 211 perpendicular to the printed circuit board on which the electrical connector is mounted. The top face 232 of the bottom wall 23 is slantwise arranged and divided into two parts by the through holes 231, wherein each part is at an angle above 90.degree. with respect to the corresponding inner face 211. Particularly pointed out that, places of the top face 232 adjacent to the inner face 211 are higher than those adjacent to the through holes 231 in the vertical direction, that means the top face 232 of the bottom wall 23 is configured as a bowl shaped and not parallel with the horizontal bottom face 233.

Referring to FIG. 3, each conductive contact 30 has a retaining portion 31 fixed in the side wall 21, a contacting portion 32 extending from the retaining portion 31 and projecting into the mating cavity 25, and a solder portion 33 extending out of the housing 20 from the retaining portion 31. The contacting portion 32 comprises a first bending portion 321, a connecting portion 322 extending upwardly from the first bending portion 321 and a second bending portion 323 connecting with the connecting portion 322 and bending inwardly thereby forming an U shaped configuration. The connecting portion 322 is cantilevered above the bottom wall 23 with its outermost end located above the through hole 231, and the second bending portion 323 is received within the corresponding passageway 241 with a free end bent downwardly to form a second contacting point 325 protruding into the mating cavity 25. The first bending portion 321 also forms a first contacting point 324 facing to the second contacting point 325 so as to electrically contact with a mating plug 200 together with the second contacting point 325.

Figure 4:
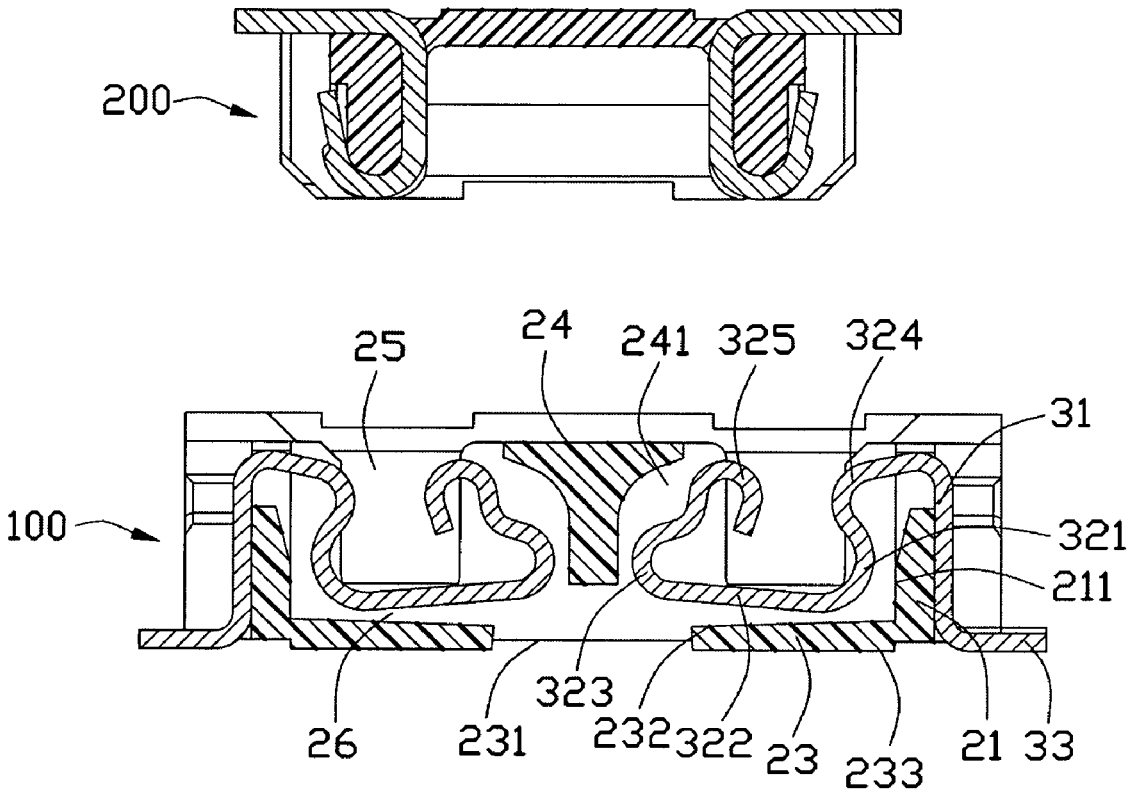
FIG. 4 is a cross-sectional view of the electrical connector and the plug connector shown in FIG. 2 along line 4-4.
Figure 5:
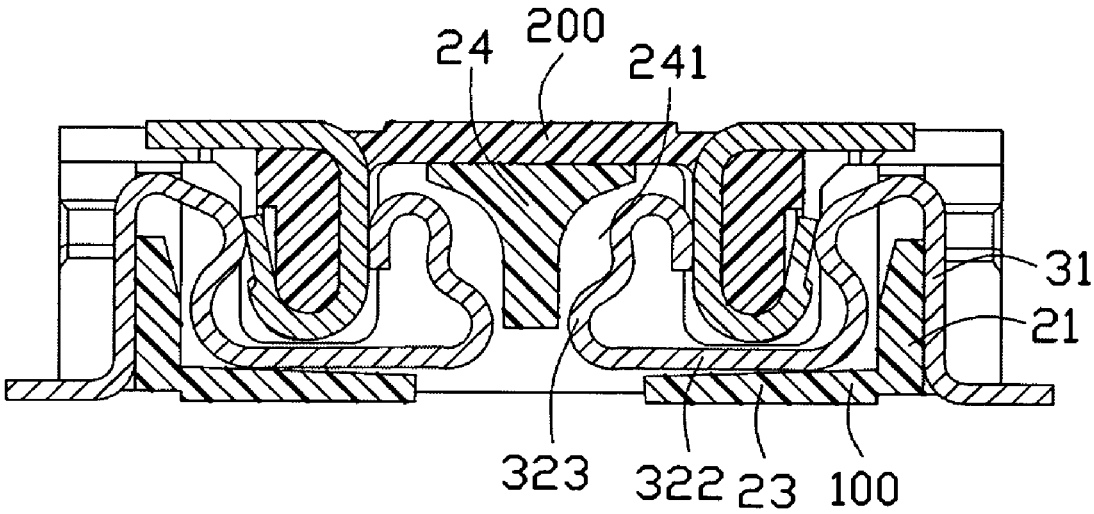
FIG. 5 is a cross-sectional view of the electrical connector and the plug connector shown in FIG. 1 along line 5-5.

Referring to FIGS. 4 and 5, when the electrical connector 100 is mating with the mating plug 200, the contacting portion 32 of each conductive contact 30 moves toward the bottom wall 23 about an end of the retaining portion 31, and the connecting portion 322 which is adjacent to the bottom wall 23 needs a large deflectable space. As described above, the places of the top face 232 adjacent to the inner face 211 are higher than those adjacent to the through holes 231, therefore the space between the upwardly extending connecting portion 322 and the top face 232 becomes larger and larger from the places adjacent to the inner face 211 to those adjacent to the through holes 231. In addition, the end of the connecting portion 322 is located above the through hole 231, which provides the connecting portion 322 a much larger deflectable space. When the electrical connector 100 is mounted onto the printed circuit board, the solder portions 33 and the bottom face 233 of the bottom wall 23 engage with the PCB thereby securing the electrical connector 100 onto the PCB fixedly.

In the present invention, the slantwise bottom wall 23 increases the rigidity of the housing 20 and simultaneously provides the deflectable space for the conductive contacts 30, although the bottom wall 23 may increase somewhat the height of the electrical connector 100, the height can be ignored when the angle between the top face 232 and the inner face 211 becomes sharply.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a plug connector comprising:

a housing having a pair of side walls defining a plurality of terminal grooves therein and a bottom wall connecting with said side walls and defining a top face facing upward;

a plurality of terminals received in said terminal grooves, each comprising a retaining portion and a contacting portion extending from the retaining portion, said contacting portion having a connecting portion cantilevered above said top face;

wherein the bottom wall defines a plurality of through holes running therethrough along a vertical direction and facing to an end of the connecting portion which is far away from the retaining portion, and said top face of the bottom wall extends slantwise from the through hole to the side walls therefore places adjacent to the through hole are lower than those adjacent to the side walls in said vertical direction.

2. The electrical connector as described in claim 1, wherein the bottom wall adjacent to the side walls is thicker than that adjacent to the through holes.

3. The electrical connector as described in claim 2, wherein the bottom wall defines a horizontal bottom face which is not parallel to the top face.

4. The electrical connector as described in claim 3, wherein the housing defines a mating cavity with a tongue plate disposed therein, said through holes are located under the tongue plate and in communication with corresponding passageways which are defined in the tongue plate.

5. The electrical connector as described in claim 4, wherein each contacting portion of the terminal also has a first bending portion and a second bending portion located at opposite ends of said connecting portion and defining an U-shaped configuration, the second bending portion is far away from said retaining portion and received in said passageway in the tongue plate.

6. The electrical connector as described in claim 5, wherein the second bending portion is located above the corresponding through hole.

7. An electrical connector comprising:

a housing having a pair of side walls extending along a longitudinal direction and a bottom wall connecting with said side walls and defining a top face facing upward;

a plurality of terminals secured in said housing, each comprising a retaining portion and a contacting portion extending from the retaining portion, said contacting portion having a connecting portion cantilevered above said top face;

wherein the bottom wall defines a plurality of through holes running therethrough and facing to an end of the connecting portion which is far away from the retaining portion, and said top face defines an angle above 90.degree with regard to the side walls.

8. The electrical connector as described in claim 7, wherein the bottom wall defines a bottom face opposite to the top face, and said side walls are perpendicular to said bottom wall.

9. The electrical connector as described in claim 8, wherein each contacting portion of the terminal also has a first bending portion and a second bending portion located at opposite ends of said connecting portion and defining an U-shaped configuration.

10. The electrical connector as described in claim 9, wherein the second bending portion is far away from said retaining portion and located above the corresponding through hole.

11. An electrical connector for mating with a complementary connector, comprising:

an insulative housing defining a longitudinal direction and a transverse direction perpendicular to each other;

an elongated mating cavity formed in the housing along said longitudinal direction, and upwardly communicating with an exterior;

a plurality of terminal grooves disposed in the housing along said elongated mating cavity;

a plurality of terminals disposed in the corresponding terminal grooves, respectively, each of said terminal defining a retaining portion outwardly facing the exterior in the transverse direction, a solder portion extending from a bottom end of the retaining portion, and a contacting portion extending inwardly from an upper end of the retaining portion, said contacting portion including an outer bending portion linked to the retaining portion and an inner bending portion linked to the outer bending portion via a connecting portion under condition that the outer bending portion, the connecting portion and the inner bending portion are essentially respectively located around an outer side, a bottom side and an inner side of the mating cavity; wherein said housing defining a side wall and a bottom wall commonly sidewardly and downwardly blocking communication between the mating cavity and the exterior around a corner between the side wall and the bottom wall for preventing solder wicking coming from the solder portion, and the bottom wall defines a top face downwardly sloping inwardly away from the side wall so as to forgiving downward deflection of the inner bending portion under condition that the outer bending portion is relatively stiffer than the inner bending portion during mating with the complementary connector.

12. The electrical connector as claimed in claim 11, wherein the bottom wall terminates around a center region of the housing in the transverse direction so as to allow the terminal passageways to downwardly communicated with the exterior around the center region.

13. The electrical connector as claimed in claim 12, wherein said inner bending portion defines a 3-shaped configuration around the center region of the housing.

14. The electrical connector as claimed in claim 12, wherein the top face of the bottom wall and a bottom face of the bottom wall converge toward each other around the center region.

15. The electrical connector as claimed in claim 11, wherein a bottom face of the bottom wall is horizontal oblique to the top face of the bottom wall.

* * * * *